US012319464B2

(12) United States Patent
Anderson

(10) Patent No.: US 12,319,464 B2
(45) **Date of Patent: *Jun. 3, 2025**

(54) CADDY WITH SPILL PREVENTION STABILIZERS

(71) Applicant: James L. Anderson, West Fargo, ND (US)

(72) Inventor: James L. Anderson, West Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/226,835

(22) Filed: Jul. 27, 2023

(65) Prior Publication Data

US 2023/0365289 A1 Nov. 16, 2023

Related U.S. Application Data

(63) Continuation of application No. 17/408,842, filed on Aug. 23, 2021, now Pat. No. 11,753,200.

(51) Int. Cl.

| | |
|---|---|
| ***B65D 1/36*** | (2006.01) |
| ***A47L 13/51*** | (2006.01) |
| ***B65D 25/28*** | (2006.01) |

(52) U.S. Cl.

CPC ..... *B65D 1/36* (2013.01); *A47L 13/51* (2013.01); *B65D 25/2826* (2013.01)

(58) Field of Classification Search

CPC ..... A47L 3/51; B65D 25/2826; B65D 25/24; B65D 25/2802; B65D 1/36; B65D 1/24; B65D 1/243; B65D 1/34; B65D 23/001; B65D 23/24; B65D 61/00; B65D 75/525; B65D 81/027; B65D 81/3806; B65D 81/3818; B65D 81/383; B65D 3/22;

(Continued)

(56) References Cited

U.S. PATENT DOCUMENTS

| | | | |
|---|---|---|---|
| 435,023 | A | 8/1890 | Robinson |
| D148,457 | S | 1/1948 | Civita |

(Continued)

FOREIGN PATENT DOCUMENTS

| | | |
|---|---|---|
| KR | 301137476.0000 | 11/2021 |
| WO | WOD214402-015 | 2/2021 |

OTHER PUBLICATIONS

Spill Spoiler—The Ultimate Detailing Caddy—Won't Scratch or Slip—Made in the USA—Amazon, Date of Oldest Photo Review Jul. 24, 2023, amazon.com, [online], [site visited Nov. 13, 2023], Available from internet URL <https://www.amazon.com/dp/B0C9S4G5M7?ref_=cm_sw_r_cp_ud_dp_GS9GSX695HNKZZ76KGYTC> (year: 2023).

*Primary Examiner* — Robert Poon
(74) *Attorney, Agent, or Firm* — Kinney & Lange, P.A.

(57) ABSTRACT

A caddy includes an outer shell, an inner compartment that is surrounded by the outer shell and connected to a top rim of the outer shell, and a handle connected to the inner compartment. The outer shell includes a plurality of exterior walls that define a plurality of corners. At each corner, a stabilizer is connected to two adjacent exterior walls and extends outward for the exterior walls. A support surface includes bottom surfaces of the exterior walls and the stabilizer, so that an area having a periphery defined by the outer ends of the stabilizers is larger than an area having a periphery defined by the corners. The inner compartment includes pockets having an open top and a closed bottom.

17 Claims, 10 Drawing Sheets

(58) Field of Classification Search
CPC ..... B65D 5/0281; B65D 7/045; B65D 7/22; B65D 9/26; B65D 11/16; B65D 21/0215; B65D 21/0233
USPC ..... 206/564, 735, 765, 203, 599, 557, 562, 206/511, 764, 139, 141, 201, 223, 545; 220/628, 631, 635, 636, 638, 773, 774, 220/507, 513, 516, 553, 555, 605, 606, 220/500, 509, 527, 592.27
See application file for complete search history.

(56) References Cited

U.S. PATENT DOCUMENTS 2,771,232 A 11/1956 Reed
D196,665 S 10/1963 Barnett
3,603,474 A * 9/1971 Erickson ..... B65D 1/243 220/23.4
3,782,582 A 1/1974 Lybbert et al.
4,111,305 A 9/1978 Thomas
4,181,226 A 1/1980 Weinert
4,204,596 A 5/1980 Davis
D257,914 S 1/1981 Wooters
D307,355 S 4/1990 Page
D327,364 S 6/1992 Mankey
D327,562 S 6/1992 Brightbill
D329,135 S 9/1992 Embree
5,267,389 A * 12/1993 Chumley ..... B65D 25/28 29/527.1
D357,119 S 4/1995 Vura et al.
D362,837 S 10/1995 Mankey et al.
5,456,357 A 10/1995 Wenner et al.
D364,039 S 11/1995 Kruger
D368,889 S 4/1996 Mankey et al.
5,509,633 A 4/1996 Ruster et al.
5,975,342 A 11/1999 Bradeen et al.
6,076,876 A 6/2000 Letourneau et al.
6,089,638 A 7/2000 Whitnell
6,221,317 B1 * 4/2001 Carl ..... B01L 9/543 211/60.1
D492,113 S 6/2004 Bayer et al.
6,880,191 B2 4/2005 Bristor
D511,894 S 11/2005 Janney et al.
D519,913 S 5/2006 Emerson
D522,751 S 6/2006 Irwin et al.
D546,063 S 7/2007 Snyder
D608,015 S 1/2010 Sandel
D608,456 S 1/2010 Sandel
D653,603 S 2/2012 Stroud et al.
D690,939 S 10/2013 Lintz et al.
D789,690 S 6/2017 Foley
D795,584 S 8/2017 Walker et al.
9,744,909 B2 8/2017 Proulx et al.
10,252,858 B1 4/2019 Pearson et al.
D876,835 S 3/2020 Libman et al.
D894,018 S 9/2020 Dominion et al.
D895,292 S 9/2020 Barness
D955,739 S 6/2022 Virtue et al.
D962,080 S 8/2022 Bonczyk et al.
D987,180 S 5/2023 Schwartz et al.
11,753,200 B2 9/2023 Anderson
2009/0194437 A1 8/2009 D'Agostino
2009/0314671 A1 * 12/2009 Anderson ..... A63B 55/57 206/315.3
2010/0044265 A1 2/2010 Ragsdale et al.
2010/0276435 A1 11/2010 Fredette
2012/0074156 A1 3/2012 Roesser
2015/0144525 A1 * 5/2015 Luke ..... A47F 5/116 206/774
2016/0001292 A1 1/2016 Motadel et al.
2017/0369225 A1 12/2017 Eberbach
2018/0235433 A1 8/2018 Dolan
2018/0242553 A1 8/2018 Németh
2020/0018425 A1 1/2020 Phillips et al.
2021/0147113 A1 * 5/2021 Workman ..... B65D 55/16
2021/0220221 A1 7/2021 Komann et al.
2021/0253302 A1 8/2021 Guindi et al.
2023/0058440 A1 2/2023 Anderson
2023/0166904 A1 6/2023 Kaur
2023/0278746 A1 9/2023 Anderson

* cited by examiner

CADDY WITH SPILL PREVENTION STABILIZERS

CROSS-REFERENCE TO RELATED APPLICATION(S)

This application is a continuation of U.S. Nonprovisional application Ser. No. 17/408,842, filed Aug. 23, 2021, and entitled "CADDY WITH SPILL PREVENTION STABILIZERS," the disclosure of which is hereby incorporated by reference in its entirety.

BACKGROUND

Individuals who feature automobiles in car shows often drive their show cars to the venue, resulting in normal dirt, etc. In preparation for competition, they then perform last minute cleaning and touch ups. It is common for individuals to bring a touch up detailing kit with them to these events. These kits, bottles, and other items, can tip over during normal driving, causing as many problems as they solve. Similar issues can occur any time a caddy is transported by vehicle, rolling cart, or other means of transportation.

SUMMARY

A caddy includes an outer shell, an inner compartment that is surrounded by the outer shell and connected to a top rim of the outer shell, and a handle connected to the inner compartment. The outer shell includes a plurality of exterior walls that define a plurality of corners. At each corner, a stabilizer is connected to two adjacent exterior walls and extends outward for the exterior walls. A support surface includes bottom surfaces of the exterior walls and the stabilizer, so that an area having a periphery defined by the outer ends of the stabilizers is larger than an area defined by the corners. The inner compartment includes pockets or cups having an open top and a closed bottom.

A caddy includes an outer shell, an inner compartment, and a handle. The outer shell includes two side walls, two end walls, a bottom edge, a top rim, and four stabilizers. Each stabilizer extends outward from one of the four corners defined by the two sidewalls and the two end walls. The inner compartment is surrounded by the outer shell and is connected to the top rim of the outer shell. The inner compartment includes a plurality of pockets or cups and a plurality of dividers that separate the pockets or cups. The handle is connected to the inner compartment.

DETAILED DESCRIPTION

Caddies are used in many situations to easily transport and organize supplies, in particular bottles of liquids and gels. When in transport, however, they are prone to tipping over, due to a high center of gravity from the tall bottles that are typically present. Tipping often results in spills and disorganization. The caddy described herein provides storage and organization while preventing tipping. The caddy includes stabilizers to provide support to stabilize the caddy and prevent it from tipping over, without significantly increasing the overall footprint or weight of the caddy.

Figure 1:
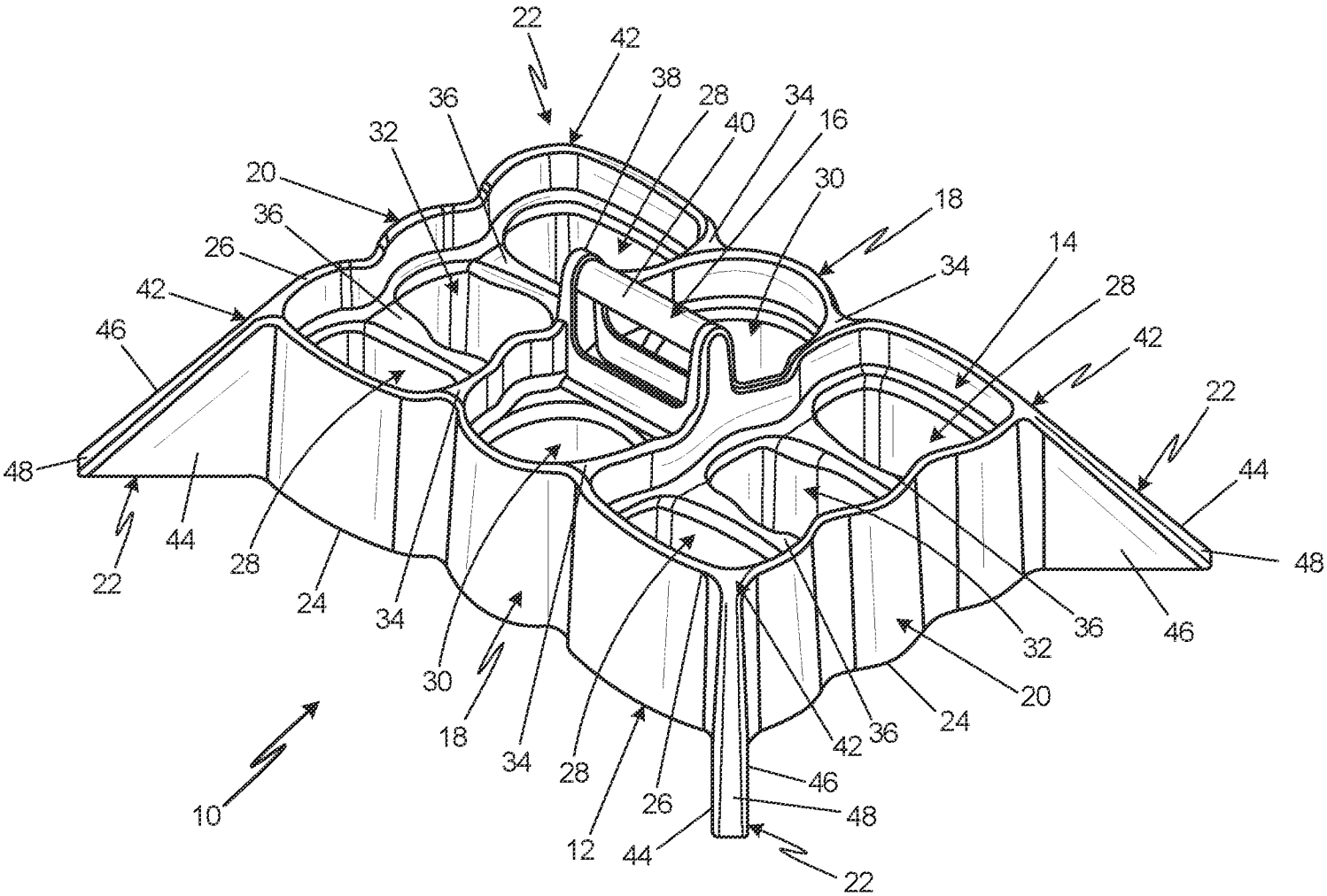
FIG. 1 is an isometric view showing an upper side of a caddy having eight pockets.

FIGS. 1-6 show caddy 10, which has eight pockets (or cups) that can be filled with bottles, towels, tools, and other objects for a variety of different manufacturers. FIG. 1 is an isometric view showing an upper side of caddy 10, which includes outer shell 12, inner compartment 14, and handle 16. Outer shell 12 includes side walls 18, end walls 20, stabilizers 22, bottom edge 24, and top rim 26. Inner compartment 14 includes corner pockets 28, side pockets 30, end pockets 32, upper dividers 34, and lower dividers 36. Handle 16 includes handle mounts 38 and crossbar 40. Handle 16 is oriented parallel to sidewalls 18 and perpendicular to end walls 20.

Caddy 10 has four corners 42. Each stabilizer 22 is located at a different one of the corners 42. Stabilizers 22 extend outward and downward from corners 42. Each stabilizer 22 includes stabilizer side wall 44, stabilizer end wall 46, and stabilizer top cap 48. Each stabilizer side wall 44 is connected to an adjacent side wall 18, and each stabilizer end wall 46 is connected to an adjacent end wall 20. Each stabilizer top cap connects adjacent stabilizer side and end walls 44 and 46 so that they are spaced from one another.

Figure 2:
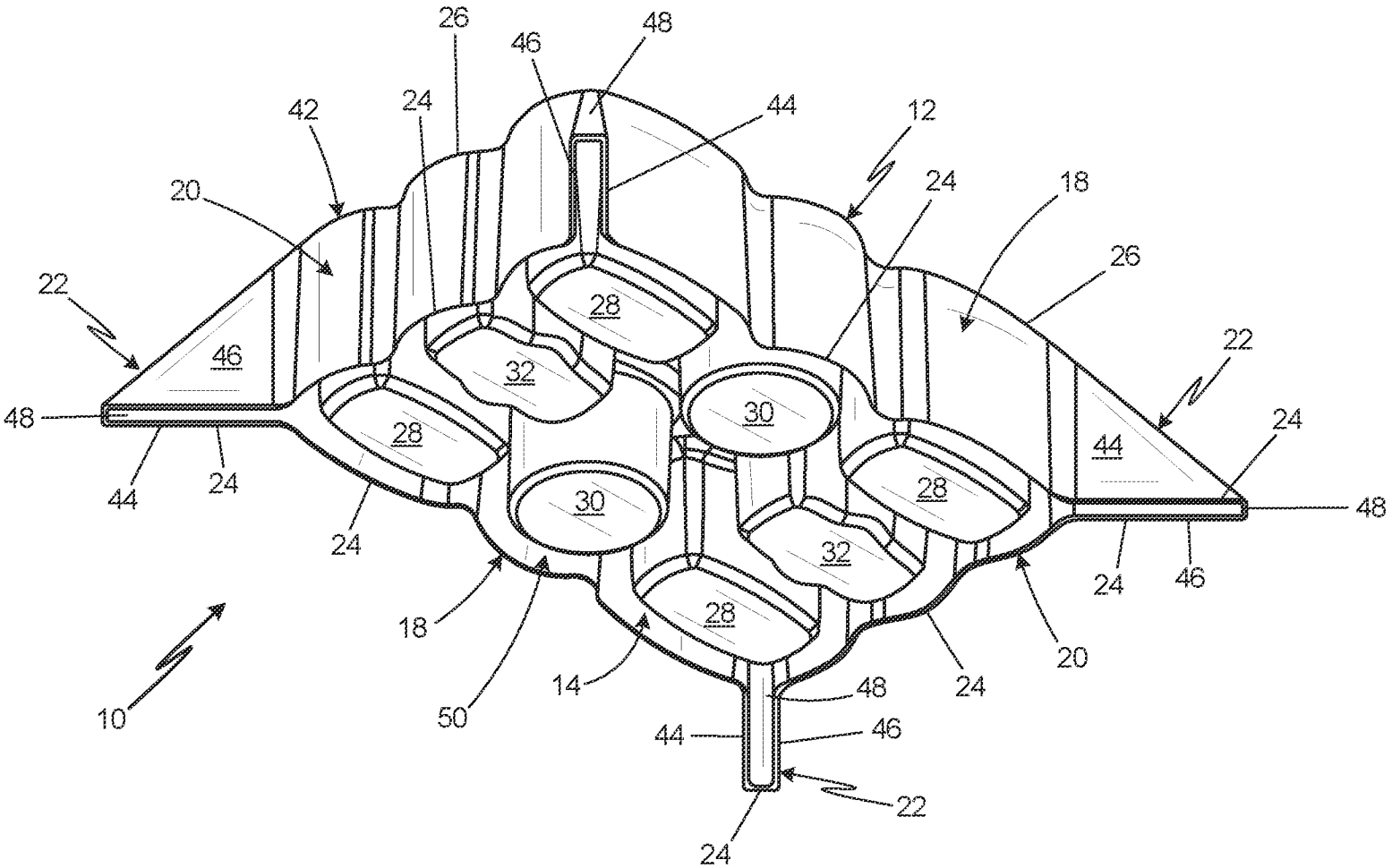
FIG. 2 is an isometric view showing an under side of the caddy of FIG. 1.

FIG. 2 shows caddy 10 from below, so that the under sides of out shell 12 and inner shell 14 can be seen. Shown in FIG. 2 are caddy 10, outer shell 12, inner compartment 14, handle 16, side walls 18, end walls 20, stabilizers 22, bottom edge 24, top rim 26, corner pockets or cups 28, side pockets 30, end pockets 32, upper divider 34, lower dividers 36, stabilizer side wall 44, stabilizer end wall 46, and stabilizer top cap 48. The double walled structure formed by outer shell 12 and inner compartment 14 is shown in FIG. 2. The double walled construction creates hollow space 50, which surrounds corner pockets 28, side pockets 30, and end pockets 32 is contained by the inner surfaces of side walls 18, end walls 20, and walls 44 and 46 and cap 48 of stabilizers 22. Hollow space 50 reduces the amount of material, and therefore the overall weight, of caddy 10. The double walled structure provides structural strength while reducing the amount of material needed to form caddy 10.

In one embodiment, caddy 10 is formed of a plastic material using a molding process, such as injection molding. In other embodiments, caddy 10 can be formed using other processes, such as rotomolding, 3D printing, compression molding, vacuum molding, and thermomolding. Caddy 10 can be made of any suitable plastic material, for example a thermoplastic, such as acrylonitrile butadiene styrene (ABS).

As shown in FIGS. 1 and 2, outer shell 12 (including side walls 18, end walls 20 and walls 44 and 46 of stabilizers 22) flares outward from top rim 26 to bottom edge 24. This increases the area encompassed by bottom edge compared to top rim 26 to provide stability to caddy 10. In addition, the flaring of outer shell 12, together with tapering of the outer surfaces of pockets 28, 30, and 32 assists in removal of caddy 10 from the mold used to form caddy 10.

Caddy 10 has a double walled structure. This provides structural strength while reducing the amount of plastic material needed to form caddy 10. Reduction in the amount of plastic required reduces the cost of materials. It also reduces the total weight of caddy 10, which is an advantage for the user.

Pockets 28, 30, and 32 of inner compartment 14 can be any suitable shape or dimension, based on the particular items that will be carried in caddy 10. In some embodiments storage compartments are circles, rectangles, and/or rounded rectangles in order to conform to the shape of the items that are intended to be stored therein. Similarly, in some embodiments inner compartment 14 is configured to snugly fit the items that are intended to be stored therein, for example, car wax, cleaning wipes, spray bottles, rags, or sponges. Pockets 28, 30, and 32 can be the same shape or different shapes to accommodate, for example, different bottle types. In some embodiments, corner pockets 28 are rounded rectangles, side pockets 30 are circular, and end pockets 132 are rounded rectangles with slight protrusions.

Figure 3:
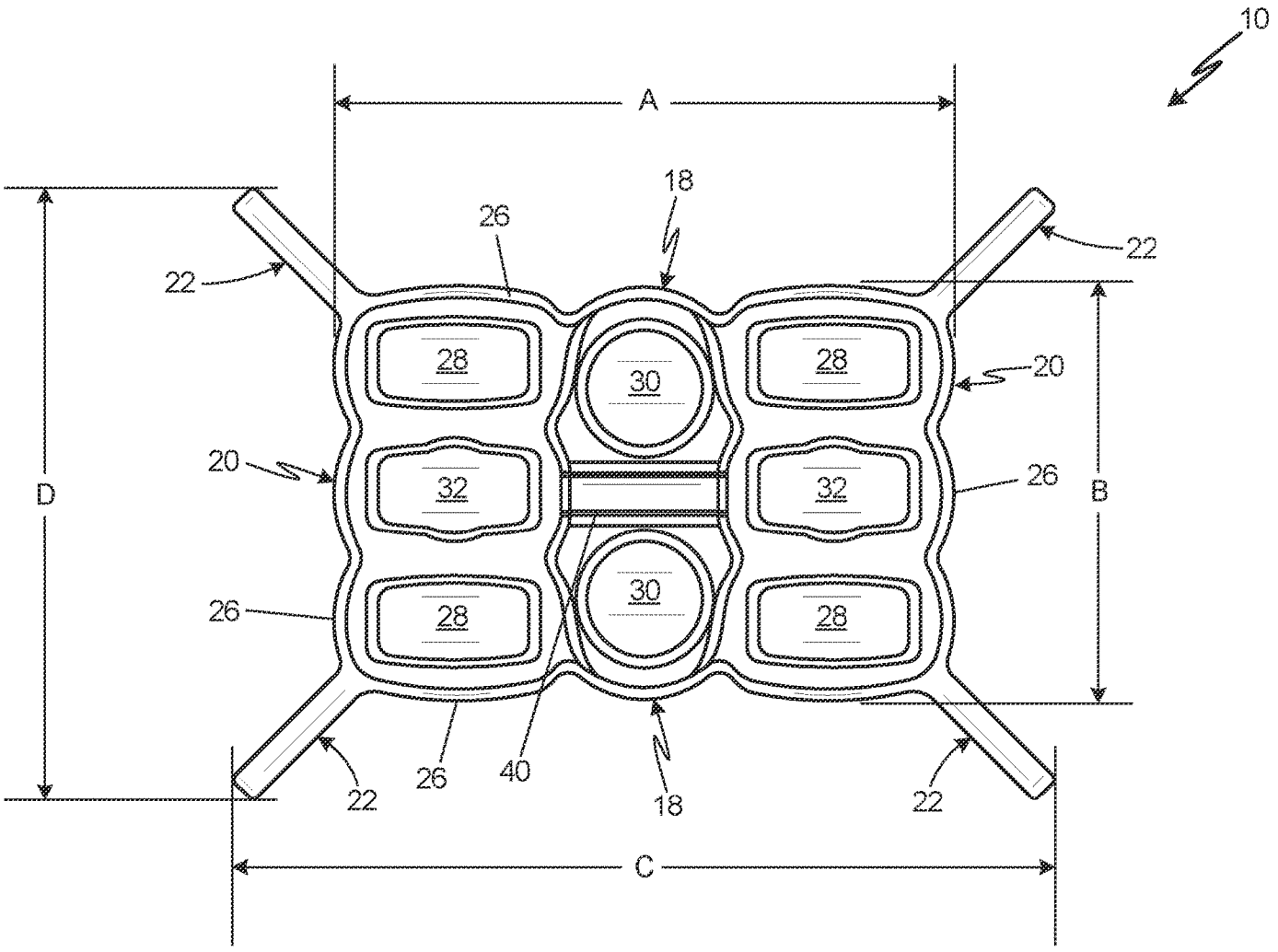
FIG. 3 is a top view of the caddy of FIG. 1.

FIG. 3 is a top view of caddy 10. Contouring of the inner walls and bottom of corner pockets 28, side pockets 30, and end pockets 32 can be seen in FIG. 3. FIG. 3 shows dimensions A-D. Dimension A is a length between the outer surfaces of end walls 20. Dimension B is a width between the outer surfaces of side walls 18. Dimension C is a length between the outer ends of two stabilizers 22 separated by side wall 18. Dimension D is a width between outer ends of two stabilizers separated by end wall 20.

Figure 4:
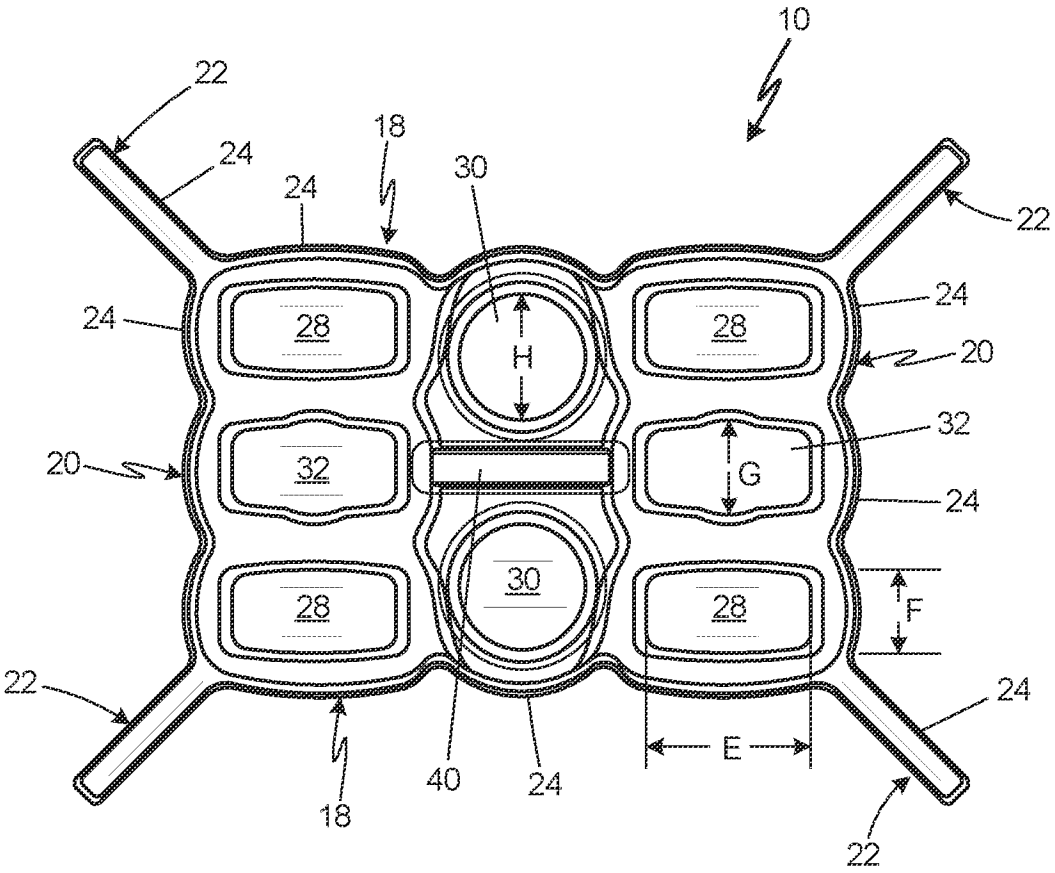
FIG. 4 is a bottom view of the caddy of FIG. 1.

FIG. 4 is a bottom view of caddy 10. Contouring of the outer walls and bottom of corner pockets 28, side pockets 30, and end pockets 32 can be seen in FIG. 4. Dimensions E-H are shown in FIG. 4. Dimension E is a bottom length of corner pockets 28, and dimension F is a bottom width of corner pockets 28. Dimension G is a bottom width of end pockets 32, which is the same as dimension E. Dimension H is the bottom diameter of side pocket 30.

Figure 5:
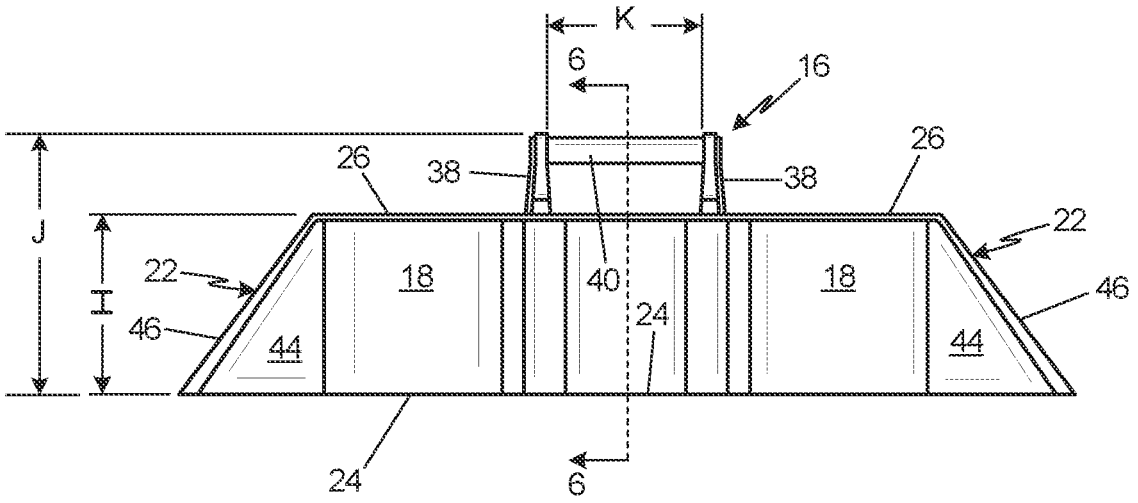
FIG. 5 is a side view of the caddy of FIG. 1.

FIG. 5 is a side view of caddy 10 showing side wall 18, stabilizers 22 at opposite ends of side wall 18, bottom edge 24, top rim 26, and handle mounts 38 and crossbar 40 of handle 16. FIG. 5 shows dimensions I-K. Dimension I is the height from bottom edge 24 to top rim 26. Dimension J is the height from bottom edge 24 to the top of handle 16. Dimension K is the length of crossbar 40 of handle 16.

Figure 6:
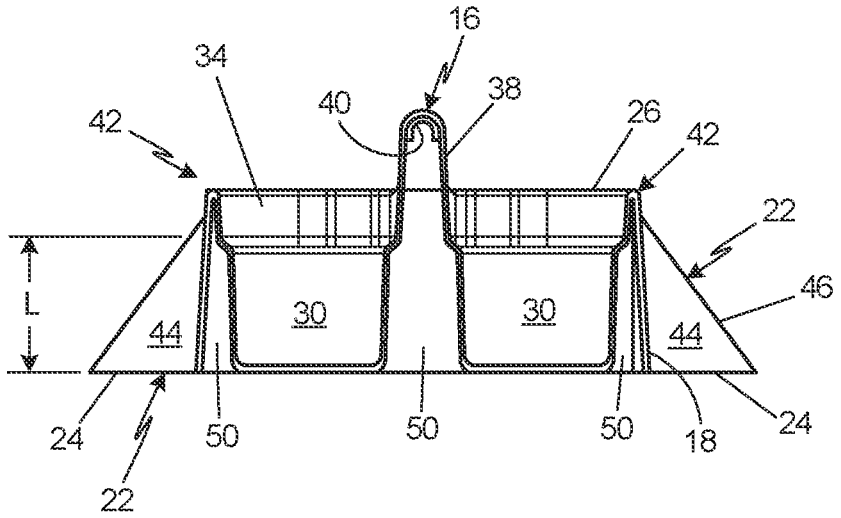
FIG. 6 is a sectional view of the caddy of FIG. 5 taken along line 6-6.

FIG. 6 is a sectional view of caddy 10 taken along section 6-6 of FIG. 5. FIG. 6 shows side walls 18, stabilizers 24, bottom edge 24, top rim 26, side pockets 30, upper divider 34, lower dividers 36, handlebar 38, crossbar 40, walls 44 and caps 46 of stabilizers 22, and hollow space 50. FIG. 6 shows dimension L, which is the height of lower dividers 36.

For example, in one embodiment, dimension A is 16⅞ inches; dimension B is 11⅜ inches; dimension C is 22⅜ inches, and dimension D is 16¾ inches. Dimension E is 4½ inches, and dimension F is 2⅜ inches; and dimension G is 4½ inches. Dimension H is 3½ inches.

Based upon dimensions A and B, the area defined by the four corners 42 of caddy 10 excluding stabilizers 22 is about 192 square inches. In contrast, based upon dimensions C and D, the area defined by the four outermost ends of stabilizers 22 is about 375 square inches. The area defined by the outer most corners of stabilizers 22 is 1.95 times larger than the same caddy without stabilizers 22. This larger support base created by stabilizers 22 provided enhanced stability for caddy 10.

Stabilizers 22 effectively lengthen and widen the base of the caddy 10, which prevents lateral forces (e.g., braking, accelerating, etc.) from causing caddy 10 toppling over. Stabilizers 22 are shown in FIGS. 1-6 as having a triangular shape, but stabilizers can take a variety of shapes so long as the outmost ends of the stabilizers both widen and lengthen the effective base area of caddy 10. Examples of other stabilizer structures include outriggers and buttresses. Although stabilizers 22 are shown as having a 45-degree angle with respect to top rim 26, the angle can be varied, for example between about 40 degrees and about 50 degrees. Increasing the angle will result in an increase in the distance stabilizers extend outward from the corners, and thus will increase the effective area defined by stabilizers 22. Reducing the angle will have an opposite effect.

When in use, the empty or full caddy 10 is placed with bottom edge 24 on a relatively flat surface, for example, a trunk floor or a shelf of a rolling cart. Items to be transported are placed in the storage compartment or compartments in an upright position. The transportation method (car, dolly, cleaning cart, etc.) can then be moved. While in transport, the buttresses stabilize the caddy, preventing it and the items being transported from tipping over, despite the items making caddy 10 top heavy, and liquids causing major shifts in the center of gravity during transport. Because stabilizers 22 are narrow, other items can be packed around the caddy with few restrictions beyond the perimeter of caddy 10.

FIGS. 7-12 show caddy 110, which has six pockets that can filled with bottles, towels, tools, and other objects. Caddy 110 shown in FIGS. 7-12 has a similar overall structure and design to caddy 10 shown in FIGS. 1-7. However, caddy 110 has six pockets rather than eight pockets, and has a smaller size than caddy 10. The reference numerals that refer to parts of caddy 110 are incremented by one hundred compared to the reference numerals that refer to parts of caddy 10 shown in FIGS. 1-7.

Figure 7:
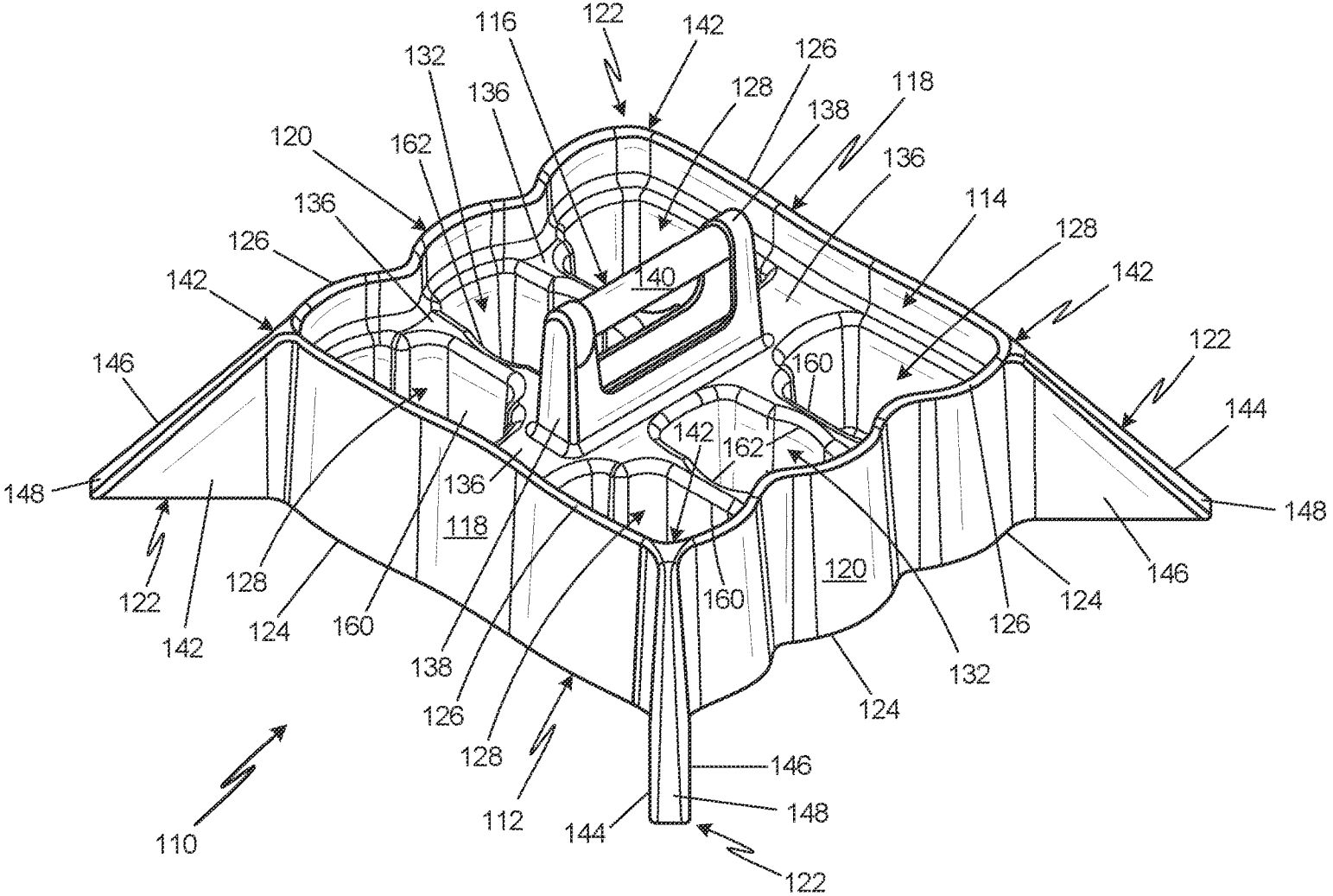
FIG. 7 is a is an isometric view showing an upper side of a caddy having six pockets.

FIG. 7 is an isometric view showing an upper side of caddy 110, which includes outer shell 112, inner compartment 114, and handle 116. Outer shell 112 includes side walls 118, end walls 120, stabilizers 122, bottom edge 124, and top rim 126. Inner compartment 114 includes four corner pockets or cups 128, two end pockets 132, and lower dividers 136. Handle 116 includes handle mounts 138 and crossbar 140. Handle 116 is oriented perpendicular to sidewalls 118 and parallel to end walls 120.

Caddy 110 has four corners 142. Each stabilizer 122 is located at a different one of the corners 142. Stabilizers 122 extend outward and downward from corners 142. Each stabilizer 122 includes stabilizer side wall 144, stabilizer end wall 146, and stabilizer top cap 148. Each stabilizer side wall 144 is connected to an adjacent side wall 118, and each stabilizer end wall 146 is connected to an adjacent end wall 120. Each stabilizer top cap 148 connects adjacent stabilizer side and end walls 144 and 146 so that they are spaced from one another.

Figure 8:
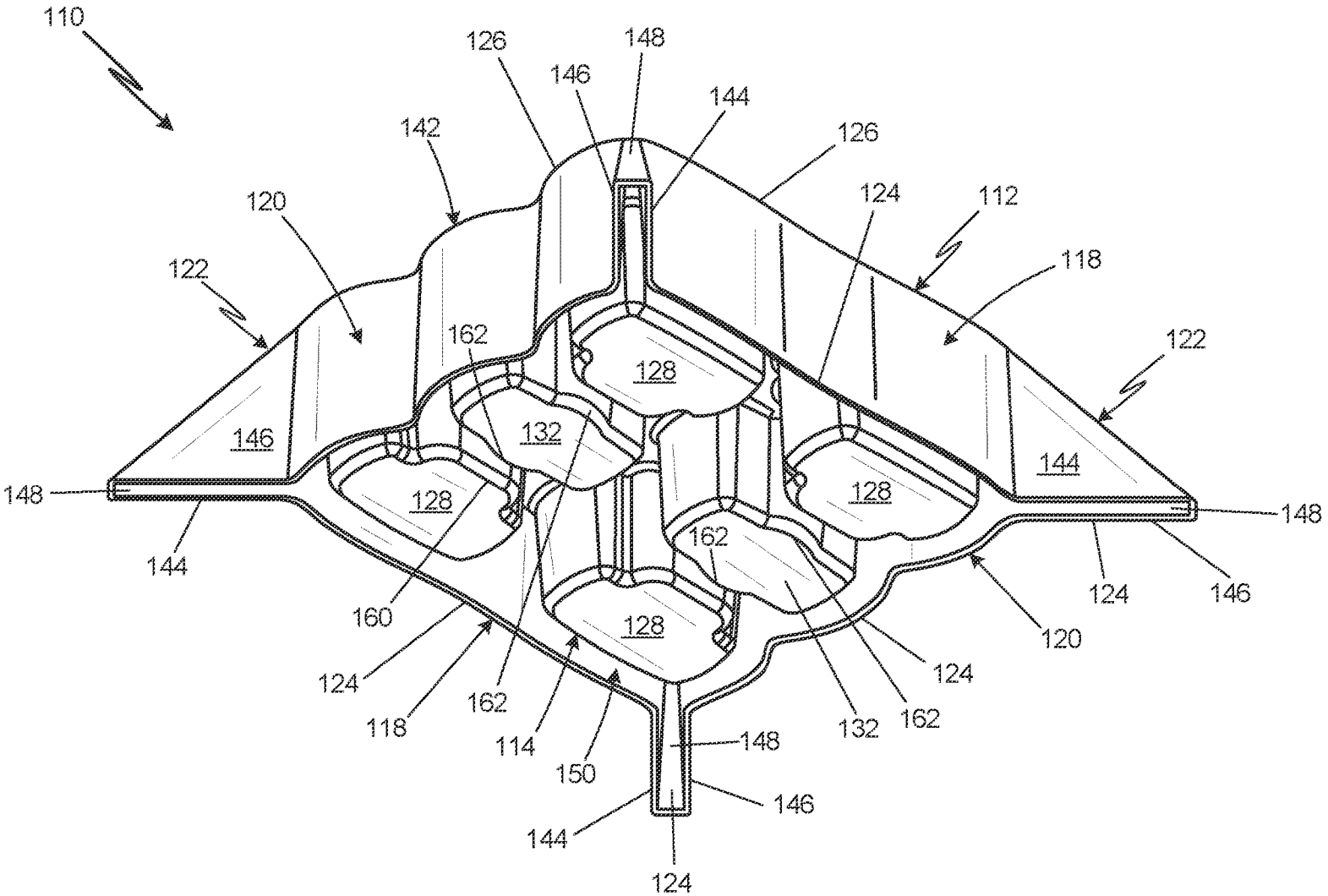
FIG. 8 is an isometric view showing an under side of the caddy of FIG. 7.

FIG. 8 shows caddy 110 from below, so that the under sides of outer shell 112 and inner shell 14 can be seen. Shown in FIG. 2 are caddy 110, outer shell 112, inner compartment 114, handle 116, side walls 118, end walls 120, stabilizers 122 (including stabilizer side wall 144, stabilizer end wall 146, and stabilizer top cap 148), bottom edge 124, top rim 126, corner pockets or cups 128, end pockets 132, and lower dividers 136. Handle 116 includes handle mounts 138 and crossbar 140. The double walled structure formed by outer shell 112 and inner compartment 114 is shown in FIG. 8. The double walled construction creates hollow space 150, which surrounds corner pockets 128, and end pockets 132, is contained by the inner surfaces of side walls 118, end walls 120, and walls 144 and 146 and top cap 148 of stabilizers 122. Hollow space 150 reduces that amount of material and therefore the overall weight of caddy 110. The double walled structure provides structural strength while reducing the amount of material needed to form caddy 110.

In one embodiment, caddy 110 is formed of a plastic material using a molding process, such as injection molding. In other embodiments, caddy 110 can be formed using other processes, such as rotomolding, 3D printing, compression molding, vacuum molding, and thermomolding. Caddy 110 can be made of any suitable plastic material, for example, a thermoplastic such as acrylonitrile butadiene styrene (ABS).

As shown in FIGS. 7 and 8, outer shell 112 (including side walls 118, end walls 120 and walls 144 and 146 of stabilizers 122) flares outward from top rim 126 to bottom edge 124. This increases the area encompassed by bottom edge compared to top rim 126 to provide stability to caddy 110. In addition, the flaring of outer shell 12, together with tapering of the outer surfaces of pockets 128 and 132 assists in removal of caddy 110 from the mold used to form caddy 110.

Caddy 110 has a double walled structure. This provides structural strength while reducing the amount of plastic material needed to form caddy 10. Reduction in the amount of plastic required reduces the cost of materials. It also reduces the total weight of caddy 110, which is an advantage for the user.

Pockets 128 and 132 of inner compartment 114 can be any suitable shape or dimension, based on the particular items that will be carried in caddy 10. In some embodiments storage compartments are circles, rectangles, and/or rounded rectangles in order to conform to the shape of the items that are intended to be stored therein. Similarly, in some embodiments inner compartment 114 is configured to snugly fit the items that are intended to be stored therein, for example, car wax, cleaning wipes, spray bottles, rags, or sponges. Pockets 128 and 132 can be the same shape or different shapes to accommodate, for example, different bottle types. In the embodiment shown in FIGS. 7-12, each corner pocket 128 is a rounded rectangle which bulge 160 that protrudes toward an adjacent end pocket 132. Each end pocket 132 is a rounded rectangle with slight arcuate bulges 162 on each side protruding toward adjacent bulges 160 of corner pockets 128.

Figure 9:
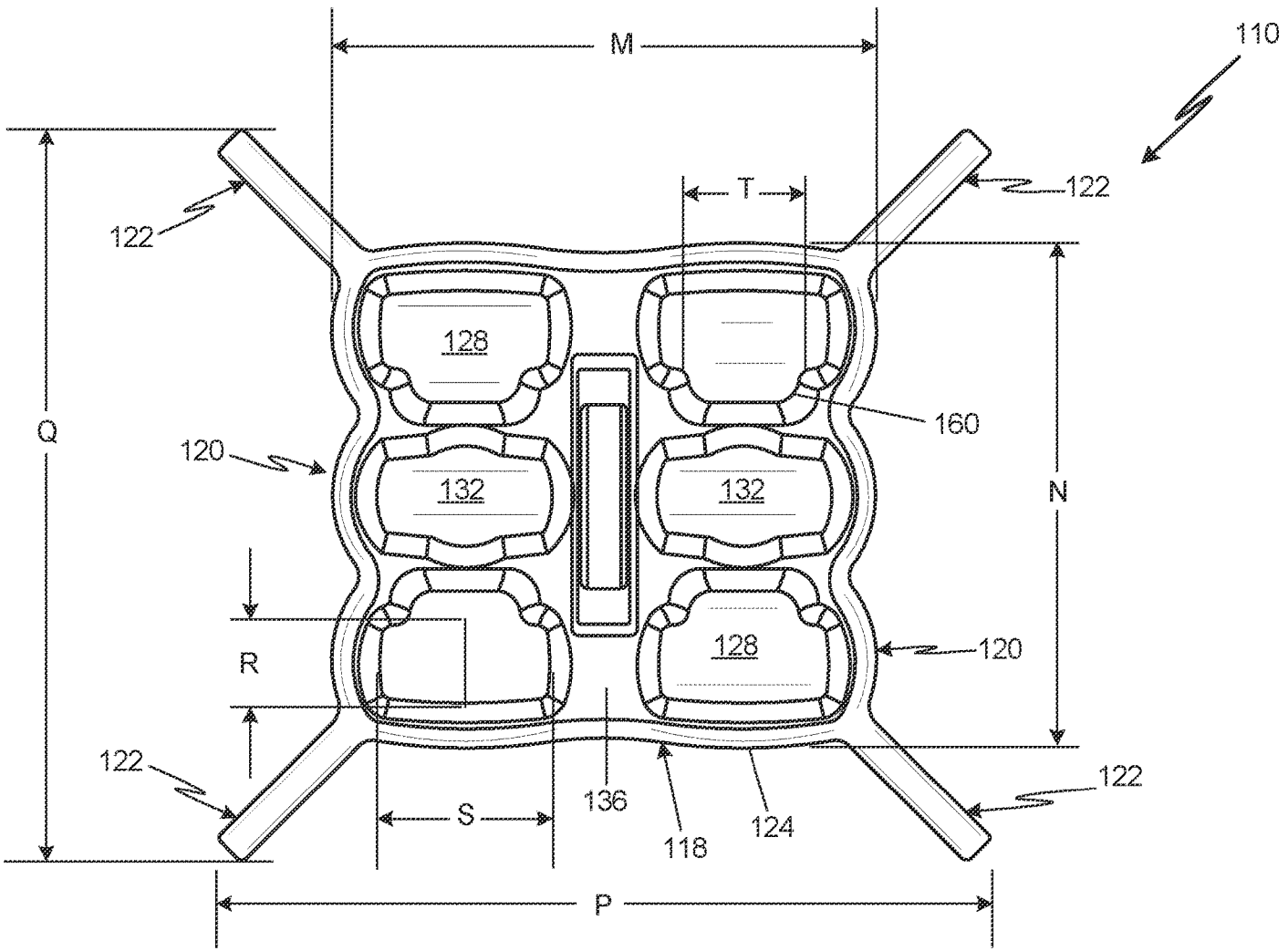
FIG. 9 is a top view of the caddy of FIG. 7.

FIG. 9 is a top view of caddy 110. Contouring of the inner walls, bottom of corner pockets 128, and end pockets 132 can be seen in FIG. 9. FIG. 9 shows dimensions M, N, P, and Q. Dimension M is a length between the outer surfaces of end walls 20. Dimension N is a width between the outer surfaces of side walls 118. Dimension P is a length between the outer ends of two stabilizers 122 separated by side wall 118. Dimension Q is a width between outer ends of two stabilizers separated by end wall 120. Dimension R is a width corner pockets 128 and end pockets 132, excluding bulges 160 and 162, respectively. Dimension S is a length of each of corner packets 128 and end products 132. Dimension T is a length of bulges 160.

Figure 10:
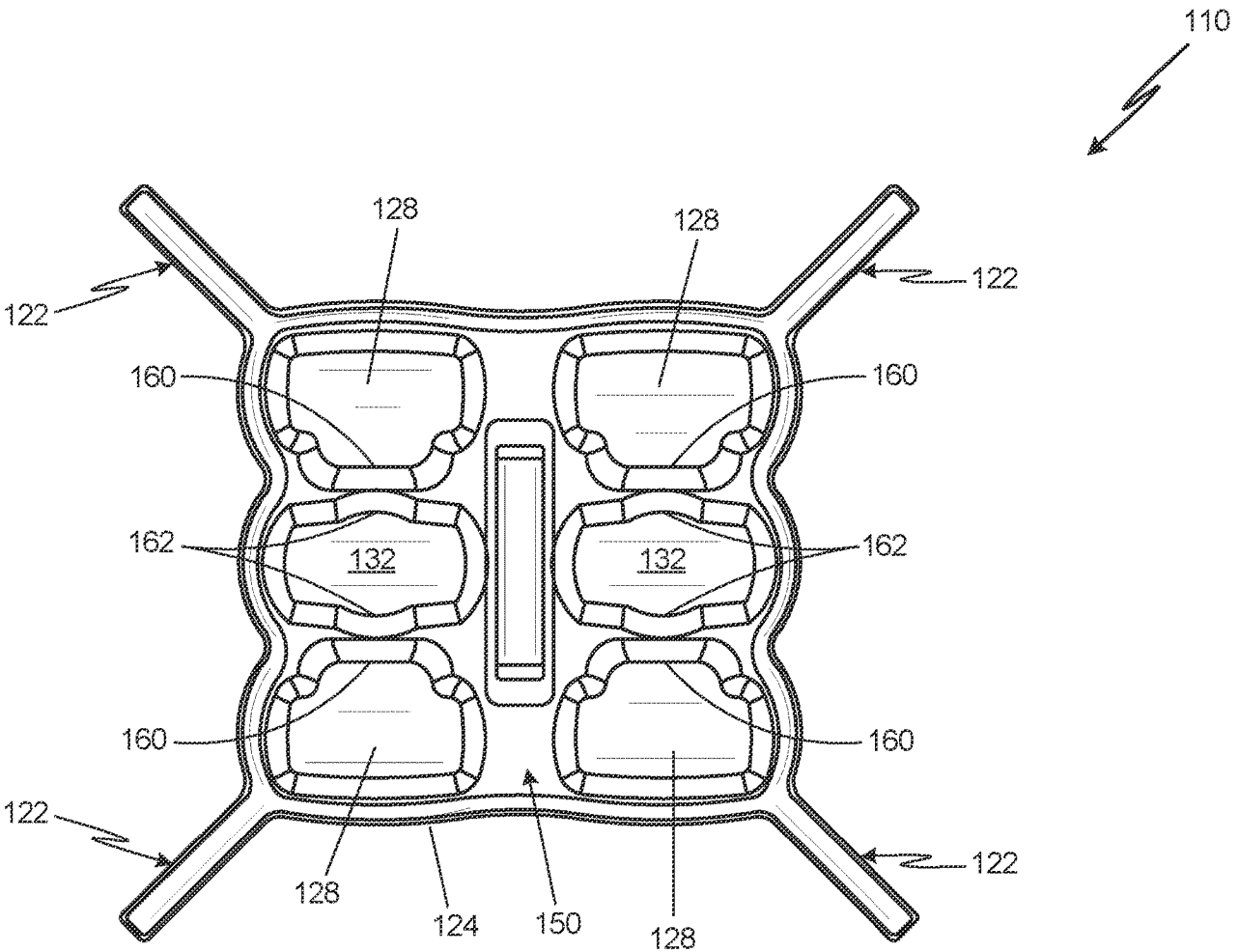
FIG. 10 is a bottom view of the caddy of FIG. 7.

FIG. 10 is a bottom view of caddy 110. Contouring of the outer walls and bottom of corner pockets 128 and end pockets 132 can be seen in FIG. 10.

Figure 11:
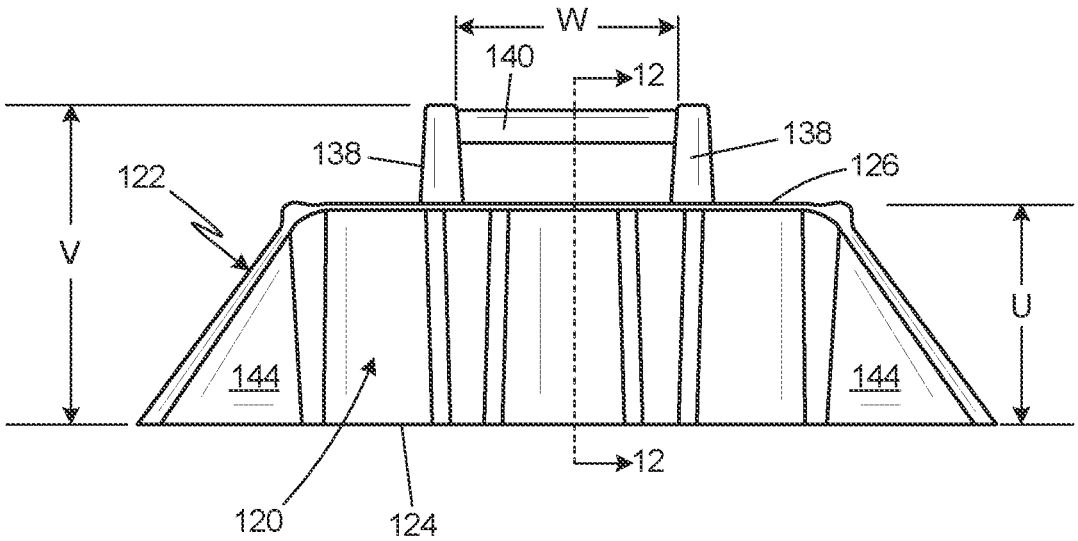
FIG. 11 is a side view of the caddy of FIG. 7.

FIG. 11 is a side view of caddy 110 showing end wall 120, stabilizers 122 at opposite ends of end wall 120, bottom edge 124, top rim 126, and handle mounts 138 and crossbar 140 of handle 116. FIG. 5 shows dimensions U-W. Dimension U is the height from bottom edge 124 to top rim 126. Dimension V is the height from bottom edge 124 to the top of handle 116. Dimension W is the length of crossbar 140 of handle 116.

Figure 12:
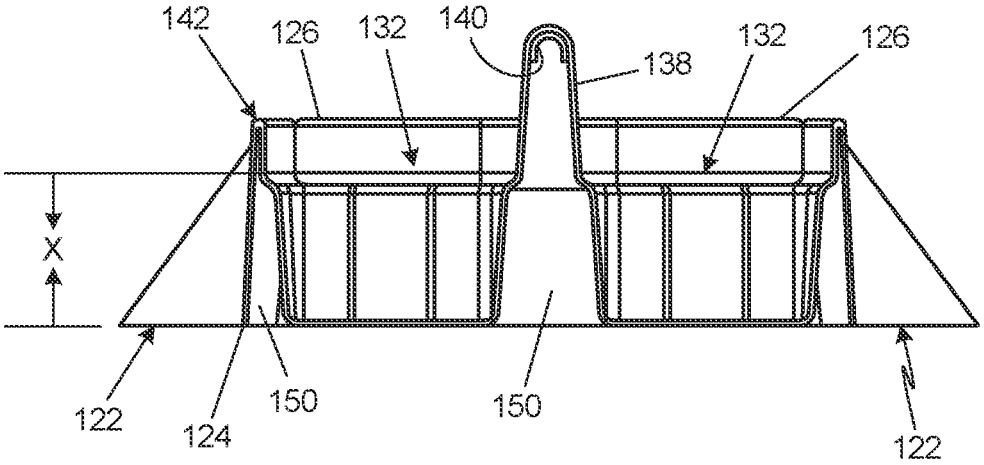
FIG. 12 is a sectional view of the caddy of FIG. 11 taken along line 12-12.

FIG. 12 is a sectional view of caddy 110 taken along section 6-6 of FIG. 11. FIG. 12 shows side walls 118, stabilizers 124, bottom edge 124, top rim 126, end pockets 132, handlebar 138, crossbar 140, walls 144 and caps 146 of stabilizers 122, and hollow space 150. FIG. 6 shows dimension L, which is the height of lowers dividers 136.

For example, in one embodiment, dimension M is 13 9/16 inches; dimension N is 121/4 inches; dimension P is 19 inches, and dimension Q is 17 13/16 inches. Dimension R is 2¼ inches, and dimension S is 4 9/16 inches; and dimension T is 2⅞ inches. Dimension U is 5½ inches; dimension V is 6½ inches; dimension W is 4½ inches; and dimension X is 3⅛ inches. Arcuate bulges 162 are based upon a circle having a diameter of 2¾ inches. Crossbar 140 of handle 116 has a width of 13/16 inch.

Based upon dimensions M and N, the area defined by the four corners of caddy 110 excluding stabilizers 122 is about 166 square inches. In contrast, based upon dimensions P and Q, the area defined by the four outermost ends of stabilizers 122 is about 338 square inches. The area defined by the outer most corners of stabilizers 122 is 2.04 times larger than the same caddy without stabilizers 122. This larger support base created by stabilizers 122 provided enhanced stability for caddy 110.

Stabilizers 122 effectively lengthen and widen the base of the caddy 110, which prevents lateral forces (e.g., braking, accelerating, etc.) from causing caddy 10 toppling over. Stabilizers 122 are shown in FIGS. 7-12 as having a triangular shape, but stabilizers 122 can take a variety of shapes so long as the outmost ends of the stabilizers both wide and lengthen the effective base area of caddy 110. Examples of other stabilizer structures include outriggers and buttresses. Although stabilizers 122 are shown as having a 45-degree angle with respect to top rim 126, the angle can be varied, for example between about 40 degrees and about 50 degrees. Increasing the angle will result in an increase in the distance stabilizers extend outward from the corners, and thus will increase the effective area defined by stabilizers 122. Reducing the angle will have the opposite effect.

When in use, the empty or full caddy 110 is placed with bottom edge 124 on a relatively flat surface, for example, a trunk floor or a shelf of a rolling cart. Items to be transported are placed in the storage compartment or compartments in an upright position. The transportation method (car, dolly, cleaning cart, etc.) can then be moved. While in transport, the buttresses stabilize the caddy, preventing it and the items being transported from tipping over, despite the items making caddy 110 top heavy, and liquids causing major shifts in the center of gravity during transport. Because stabilizers 122 are narrow, other items can be packed around the caddy with few restrictions beyond the perimeter of caddy 110.

While the invention has been described with reference to an exemplary embodiment(s), it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the particular embodiment(s) disclosed, but that the invention will include all embodiments falling within the scope of the appended claims.

The invention claimed is:

1. A caddy comprising:

an outer shell comprising:

a plurality of exterior walls that define a plurality of corners;

a plurality of stabilizers, each stabilizer connected at one of the corners to two adjacent exterior walls of the plurality of exterior walls and extend outward from the plurality of exterior walls;

a support surface that includes bottom surfaces of the plurality of exterior walls and the plurality of stabilizers; and a top rim;

wherein an area having a periphery defined by outer ends of the plurality of stabilizers is larger than an area having a periphery defined by the plurality of corners;

wherein the outer shell flares outward from the top rim to the bottom surfaces of the plurality of exterior walls such that an area encompassed by the bottom surfaces of the plurality of exterior walls is larger than an area encompassed by the top rim; and an inner compartment surrounded by the outer shell and connected to the top rim, the inner compartment including a plurality of pockets, each of the plurality of pockets having an open top and a closed bottom; and wherein each of the plurality of pockets taper from a top to a bottom with a compound bevel, and wherein bottom surfaces of the closed bottoms of the pockets are flush with the bottom surfaces of the exterior walls of the outer shell; and a handle connected to the inner compartment.

2. The caddy of claim 1 wherein the plurality of exterior walls includes two side walls and two end walls that define four corners, and wherein the plurality of stabilizers includes four stabilizers, one at each of the four corners.

3. The caddy of claim 2, wherein each of the four stabilizers includes a first stabilizer wall connected to one of the side walls, a second stabilizer wall connected to one of the end walls, and a cap that connects the first stabilizer wall and the second stabilizer wall.

4. The caddy of claim 2, wherein the inner compartment includes four corner pockets, and two end pockets, wherein each corner pocket is located adjacent one of the four corners, and each end pocket is located between two of the corner pockets and adjacent one of the end walls.

5. The caddy of claim 4, wherein the inner compartment further includes two side pockets, and wherein each side pocket is located between two of the corner pockets and is adjacent one of the side walls.

6. The caddy of claim 1, wherein the area having a periphery defined by outer ends of the stabilizers is at least 1.95 times larger than the area defined by the plurality of corners.

7. A caddy comprising:

an outer shell comprising:

a plurality of exterior walls that define a plurality of corners;

a plurality of stabilizers, each stabilizer connected at one of the plurality of corners to two adjacent exterior walls of the plurality of exterior walls and extend outward from the plurality of exterior walls;

a bottom edge that includes bottom surfaces of the exterior walls; and a top rim;

wherein an area having a periphery defined by outer ends of the stabilizers is larger than an area having a periphery defined by the plurality of corners;

an inner compartment surrounded by the outer shell and connected to the top rim, the inner compartment including a plurality of pockets, wherein each of the plurality of pockets taper from a top to a bottom with a compound bevel, and wherein bottom surfaces of the closed bottoms of the pockets are flush with the bottom surfaces of the exterior walls of the outer shell;

a hollow space surrounding each of the pockets of the inner compartment and contained by an inner surface of the plurality of walls of the outer shell, wherein the hollow space flares outward from the top rim to the bottom edge such that the hollow space is narrower at a top than a bottom; and a handle connected to the inner compartment.

8. The caddy of claim 7, wherein the inner compartment includes four corner pockets, and two end pockets, wherein each corner pocket is located adjacent one of the corners, and each end pocket is located between two of the corner pockets and adjacent one of the end walls.

9. The caddy of claim 8, wherein the inner compartment further includes two side pockets, and wherein each side pocket is located between two of the corner pockets and is adjacent one of the side walls.

10. The caddy of claim 7, wherein each pocket has an open top and a closed bottom, wherein bottom surfaces of the closed bottoms of the pockets are flush with the bottom surfaces of the plurality of exterior walls of the outer shell, and wherein the pockets taper from a top to a bottom with a compound bevel.

11. A caddy comprising:

an outer shell comprising:

a plurality of exterior walls that define a plurality of corners;

a plurality of stabilizers, each stabilizer connected at one of the plurality of corners to two adjacent exterior walls of the plurality of exterior walls and extend outward from the plurality of exterior walls;

a bottom edge that includes bottom surfaces of the exterior walls; and a top rim;

wherein an area having a periphery defined by outer ends of the stabilizers is larger than an area having a periphery defined by the plurality of corners;

an inner compartment surrounded by the outer shell and connected to the top rim, the inner compartment including a plurality of pockets;

a hollow space surrounding the pockets of the inner compartment and contained by an inner surface of the plurality of walls of the outer shell, wherein the hollow space flares outward from the top rim to the bottom edge such that the hollow space is narrower at a top than a bottom; and a handle connected to the inner compartment;

wherein the outer shell flares outward from the top rim to the bottom edge such that an area encompassed by the bottom edge is larger than an area encompassed by the top rim.

12. A caddy comprising:

an outer shell comprising:

a plurality of exterior walls that define a plurality of corners;

a plurality of stabilizers, each stabilizer connected at one of the corners to two adjacent exterior walls of the plurality of exterior walls and extend outward from the plurality of exterior walls;

a support surface that includes bottom surfaces of the plurality of exterior walls and the plurality of stabilizers; and a top rim;

wherein an area having a periphery defined by outer ends of the plurality of stabilizers is larger than an area having a periphery defined by the plurality of corners; and wherein the outer shell flares outward from the top rim to the bottom surfaces of the plurality of exterior walls such that an area encompassed by the bottom surfaces of the plurality of exterior walls is larger than an area encompassed by the top rim;

an inner compartment surrounded by the outer shell and connected to the top rim, the inner compartment including a plurality of pockets, each of the plurality of pockets having an open top and a closed bottom;

a handle connected to the inner compartment; and a hollow space surrounding the plurality of pockets of the inner compartment and contained by an inner surface of the plurality of walls of the outer shell, wherein the hollow space flares outward from the top rim to the bottom surfaces of the plurality of exterior walls such that the hollow space is narrower at a top than a bottom.

13. The caddy of claim 12 wherein the plurality of exterior walls includes two side walls and two end walls that define four corners, and wherein the plurality of stabilizers includes four stabilizers, one at each of the four corners.

14. The caddy of claim 13, wherein each of the four stabilizers includes a first stabilizer wall connected to one of the side walls, a second stabilizer wall connected to one of the end walls, and a cap that connects the first stabilizer wall and the second stabilizer wall.

15. The caddy of claim 13, wherein the inner compartment includes four corner pockets, and two end pockets, wherein each corner pocket is located adjacent one of the four corners, and each end pocket is located between two of the corner pockets and adjacent one of the end walls.

16. The caddy of claim 15, wherein the inner compartment further includes two side pockets, and wherein each side pocket is located between two of the corner pockets and is adjacent one of the side walls.

17. The caddy of claim 12, wherein the area having a periphery defined by outer ends of the stabilizers is at least 1.95 times larger than the area defined by the plurality of corners.

* * * * *